US007140721B2

(12) United States Patent
Suzuki et al.

(10) Patent No.: US 7,140,721 B2
(45) Date of Patent: Nov. 28, 2006

(54) HEAT GENERATING RESISTIVE ELEMENT, SUBSTRATE FOR LIQUID DISCHARGE HEAD HAVING THE HEAT GENERATING RESISTIVE ELEMENT, LIQUID DISCHARGE HEAD, AND MANUFACTURING METHOD THEREFOR

(75) Inventors: Hiroyuki Suzuki, Yokohama (JP); Tatsumi Shoji, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 11/001,054

(22) Filed: Dec. 2, 2004

(65) Prior Publication Data

US 2005/0122379 A1 Jun. 9, 2005

(30) Foreign Application Priority Data

Dec. 5, 2003 (JP) ..... 2003-407509

(51) Int. Cl.
*B41J 2/05* (2006.01)

(52) U.S. Cl. ..... 347/62; 347/56

(58) Field of Classification Search ..... 347/20, 347/56, 61, 62, 63, 65, 67; 29/890.1, 611, 29/610.1
See application file for complete search history.

(56) References Cited

U.S. PATENT DOCUMENTS

| | | | | |
|---|---|---|---|---|
| 4,723,129 | A | 2/1988 | Endo et al. | 347/56 |
| 4,740,796 | A | 4/1988 | Endo et al. | 347/56 |
| 6,375,312 | B1 | 4/2002 | Ikeda et al. | 347/62 |
| 6,441,839 | B1 * | 8/2002 | Masutani et al. | 347/203 |

FOREIGN PATENT DOCUMENTS

| | | |
|---|---|---|
| JP | 7-125218 | 5/1995 |

OTHER PUBLICATIONS

*Note: Counterpart U.S. Patent No. 6,375,312 B1 also cited.

* cited by examiner

*Primary Examiner*—Juanita D. Stephens
(74) *Attorney, Agent, or Firm*—Fitzpatrick, Cella, Harper & Scinto

(57) ABSTRACT

A heat generating resistive element which is used in a liquid discharge head for discharging a liquid from a discharge port by thermal energy, consisting of a composition ratio of 15–30 at % Fe, 35–60 at % Si, 10–50 at % N and 1–10 at % O, in total to 100 at % or substantially 100 at %.

6 Claims, 5 Drawing Sheets

HEAT GENERATING RESISTIVE ELEMENT, SUBSTRATE FOR LIQUID DISCHARGE HEAD HAVING THE HEAT GENERATING RESISTIVE ELEMENT, LIQUID DISCHARGE HEAD, AND MANUFACTURING METHOD THEREFOR

BACKGROUND OF THE INVENTION

1. Field of the Invention

The present invention relates to a heat generating resistive element of a liquid discharge head (which may be hereafter called an ink jet head or a recording head) for recording or printing letters, marks and images on a recording medium containing paper, a plastic sheet, fabric and an article, by discharging a functional liquid such as ink; a substrate for the liquid discharge head having the heat generating resistive element; the liquid discharge head; and a manufacturing method therefor.

2. Related Background Art

An ink jet recording device with the use of this kind of ink jet heads (recording heads) has the characteristic of recording an image of high definition at high speed, by discharging ink of fine droplets from a discharge port at high speed. Particularly, an ink jet recording device which employs an electrothermal conversion body for an energy generating device for generating energy used for discharging ink, and has the system of discharging an ink bubble produced by the heat energy generated by the electrothermal conversion body, is suitable for the higher-definition and higher-speed recording of images, and the miniaturization and colorization of a recording head and a recording device, so that it has attracted a great deal of attention in recent years. (For instance, see U.S. Pat. Nos. 4,723,129 and 4,740,796).

FIG. 1 is a schematic plan view showing the general configuration of an essential part of a substrate in a recording head used for ink jet recording as described above. FIG. 2 is a schematic sectional view of a substrate 2000 for an ink jet recording head cut along an 2—2 line corresponding to an ink channel in FIG. 1.

As shown in FIG. 1, a plurality of discharge ports 1001 are arranged in this ink jet recording head, and an electrothermal conversion element 1002 generating a thermal energy used for discharging ink from each discharge port 1001 is installed on a substrate 1004 of each ink channel 1003. The electrothermal conversion element 1002 mainly comprises a heat generating resistive element 1005, an electrode interconnection 1006 for supplying an electric power thereto, and an insulating film 1007 for protecting them.

Each ink channel 1003 is formed by jointing a top board having a plurality of channel walls 1008 integrated therein to a substrate 1004 while aligning a relative position of it to an electrothermal conversion element 1002 on a substrate 1004 by a method such as image processing. Each ink channel 1003 has the end on the opposite side of a discharge port 1001 communicating with a common liquid chamber 1009, in which the ink supplied from an ink tank (not shown) is stored.

The ink supplied to the common liquid chamber 1009 is led to each ink channel 1003, forms a meniscus in the proximity of a discharge port 1001, and is retained there. At this moment in time, an ink head selectively drives an electrothermal conversion element 1002, rapidly heats the ink on a thermic effect surface to boil it with the use of the generated heat energy, and discharges the ink through an impulse force generated by boiling.

Referring to FIG. 2, a substrate 2000 for an ink jet recording head is constituted by multilayers consisting of a silicon substrate 2001, a heat storage layer 2002 made of a thermal oxide film, an interlayer film 2003 which also serves as a heat storage function and is made of a SiO film or a SiN film, a heat generating resistive layer 2004, metal wiring 2005 made from Al, Al—Si and/or Al—Cu, a protective layer 2006 made of a SiO film and a SiN film, and a cavitation resistant film 2007 for protecting the protective layer 2006 from chemical and physical shocks caused by the heating of the heat generating resistive layer 2004. The substrate 2000 for the ink jet recording head has a thermic effect portion 2008 of the heat generating resistive layer 2004 configured on one part of the top face.

The heat generating resistive element used in such a recording head is required to have characteristics in the following:

(1) being superior in thermal responsiveness and capable of instantly discharging ink;

(2) having slight change in an ohmic value after a continuous driving operation at high speed, and capability of stabilizing the bubbling state of ink;

(3) having superior heat resistance and thermal stress properties, the long life, and high reliability.

As a heat generating resistive element satisfying these requests, the configuration of using TaN for the material of the heat generating resistive element is disclosed in Japanese Patent Application Laid-Open No. H07-125218.

The stability of the characteristics of a TaN film constituting a heat generating resistive element, particularly the rate of change in resistance after the heat generating resistive element has repeated a recording operation over a long period of time, has a strong correlation with a composition of a TaN film. When tantalum nitride including $TaN_{0.8\ hex}$ among the TaN films constitutes a heat generating resistive element, the heat generating resistive element shows a low rate of change in electrical resistance after having repeated the recording operation over a long period of time, and superior discharge stability.

However, as described above, an ink-jet recording device has been increasingly required in recent years to have higher functions such as higher picture quality and recording at higher speed.

Among them, as for the improvement of picture quality, the picture quality can be improved by decreasing the size of a heater (a heat generating resistive element) and by reducing a dot size (reducing a discharge quantity per dot). In addition, as for the higher-speed recording, the speed of recording can be increased by driving a heater in shorter pulses than before and consequently increasing a driving frequency.

However, in order to drive a heater at high frequency in an ink jet head configuring a reduced size of a heater for coping with higher picture quality as described above, the heater (a heat generating resistive element) is needed to increase a sheet resistance value.

FIGS. 3A and 3B is a view for describing a relation between a heater size and various drive conditions. FIG. 3A shows the relation between the sheet resistance value of a heat generating resistive element and the value of an electrical current with respect to a driving pulse width, when a heater size changes from a large size (A) to a small size (B) while a driving voltage is constant. In addition, FIG. 3B shows the relation between the sheet resistance value of a heat generating resistive element and the value of an electrical current with respect to the driving voltage, when the heater size changes from the large size (A) to the small size (B) while the driving pulse width is constant. In FIGS. 3A and 3B, a solid line shows the sheet resistance value, and a broken line shows the value of the electrical current.

As is evident from FIGS. 3A and 3B, in order to drive an ink jet head having the decreased size of a heater in the same condition as a conventional one, the sheet resistance value has to be increased. In addition, a method for driving by increasing the sheet resistance value and the driving voltage reduces the value of an electrical current in relation to energy, so that it can save energy. Particularly, in the case of a liquid discharge head arranging a plurality of heat generating resistive elements therein, the effect becomes great.

However, $HfB_2$, TaN, TaAl or TaSiN, which have been conventionally used for the material of a heat generating resistive element in the ink jet recording head as described above, show a specific resistance value of about 200 to 800 [μΩcm]. In consideration of stably manufacturing the heat generating resistive element and stabilizing the discharge characteristics of a liquid, the maximum film thickness of the formed heat generating resistive element is limited to about 400 angstrom, but the sheet resistance value obtained when employing the above described materials is limited to about 200 [Ω/□]. Consequently, it is difficult to obtain a higher sheet resistance value than the above value so long as using the above described material.

From this reason, conventionally, there has not been such a heat generating resistive element for an ink-jet recording head as to have superior thermal responsiveness in short pulse drive and a high sheet resistance value. Furthermore, when making a heater size small and the ink-jet recording head discharge small ink drops in order to obtain a recording image of higher definition, a conventional heat generating resistive element has to increase the value of an electrical current passing through it, and consequently have caused the problem of increasing heat generation and consequent energy consumption.

SUMMARY OF THE INVENTION

A major object of the present invention is to solve the above described problems with a heat generating resistive element used in a conventional liquid discharge head, and is to provide such a heat generating resistive element as to provide recording images of a high grade over a long period of time, a substrate for a liquid discharge head having the heat generating resistive element, the liquid discharge head, and a manufacturing method therefor.

In addition, another object of the invention is to provide a heat generating resistive element for enabling a liquid discharge head to stably discharge a droplet even when the liquid discharge head reduces the size of dots formed by discharged droplets in order to realize the higher definition of a recording image and is driven at high speed in order to realize higher speed recording; a substrate for the liquid discharge head having the heat generating resistive element; the liquid discharge head; and a manufacturing method therefor.

As described above, a heater (a heat generating resistive element) for an ink jet head is required to acquire further high resistance. The easiest method for giving the heat generating resistive element higher resistance is to apply a new material capable of realizing it to the heat generating resistive element. For this reason, the present inventors have surveyed literatures of bulletins, technical books and other reports, and consequently arrived at finding that a heat generating resistive element constituted by a material such as CrSiN or CrSiON can have high resistance and durability. In addition, as a result of evaluating the characteristics (higher-resistance and durability) of the materials, a very satisfactory result was obtained, so that the present inventors have already proposed the constitution of the heat generating resistive element with the material such as CrSiN or CrSiON.

By the way, in summary of the above described materials suitable for application to the heater of an ink jet head, it is understood that a material consisting of such a metal silicide combined with nitrogen as is represented by TaSiN and CrSiN, is superior as a material of such a heater. From these viewpoints, physical properties such as specific resistance, of the metal silicide were further investigated, and the present inventors arrived at the anticipation that FeSi would be superior as the material of the heater for the ink jet head.

$\beta$-$FeSi_2$ has a prismatic crystal structure, and has the specific resistance of 2,000 [μΩcm]. As described above, $\beta$-$FeSi_2$ even of a metal silicide has extremely high specific resistance, and has a possibility of making the specific resistance further high by combining nitrogen with the material. However, it has to be confirmed whether such a material possesses desired durability, or not. So, an FeSiN film was actually formed by using an FeSi target, and the characteristics thereof were evaluated. FIG. 4 is a graph showing the result of the evaluation of the characteristics.

The graph of FIG. 4 shows the correlation between the partial pressure of nitrogen and the specific resistance when an FeSiN film was formed with a sputtering method. As shown in the graph, the FeSiN film has the specific resistance of about 2,000 [μΩcm] when the partial pressure of nitrogen is 5%, and can have the further higher specific resistance with the increase of the partial pressure of nitrogen. In addition, TCR (temperature coefficient of resistance) of the film formed at a 12.5% partial pressure of nitrogen was evaluated to prove that the value was extremely low as about +90 [ppm/° C.]. From these facts, it was found that the FeSiN film has extremely superior durability in spite of having high specific resistance.

Then, the present inventors researched the reproducibility of the characteristics of the FeSiN film formed in the condition of a 10% partial pressure of nitrogen. As a result, it was found that when the film formation was continuously repeated 30 times in the same condition, the specific resistance varied by about +10% at the maximum. The cause of the phenomenon was pursued, then oxygen was detected in the formed film, and it was elucidated that the dispersion of the oxygen content just led to the dispersion of the specific resistance. It was considered that this happens because oxygen formed by the decomposition of $H_2O$ existing in the background when a film-forming chamber was exhausted into vacuum is taken into the film, and that variation of the background caused variation in the amount of existing $H_2O$, and consequently variation in the amount of oxygen taken in the film. As a measure against the variation, the present inventors carried out the experiment of forming the FeSiN film in a background added with about 1 to 2% oxygen, and proved that the addition can control the amount of oxygen in the film. It was also found that the films which were repeatedly formed in the condition added with oxygen can have the improved reproducibility of the specific resistance in comparison with the films which were formed in a condition added with no oxygen, and consequently have the dispersion of the specific resistance improved into around 5%.

Thus, in order to achieve the above described objects, a heat generating resistive element according to the present invention used in a liquid discharge head for discharging a liquid from a discharge port by thermal energy, consisting of a composition ratio of 15–30 at % Fe, 35–60 at % Si, 10–50 at % N and 1–10 at % O, in total to 100 at % or substantially 100 at %.

This heat generating resistive element thin film may contain additional element(s) in trace amount other than the above-mentioned elements without degrading the desired properties, or the total amount of Fe, Si, O and N may be substantially 100 at %. For example, the ratio of total number (Fe+Si+O+N) of atoms of Fe, Si, O and N for all atoms constituting the material may be preferably not less than 99.5 at % and more preferably 99.9 at %.

The surface or the interior of the thin film may contain gas in the reaction area. However, such gas as Ar (Argon) having a slight amount does not affect the properties or the effects. For such impurities, at least one element may be selected from Ar, C, B, Na and Cl.

The above described heat generating resistive element according to the present invention has the TCR characteristic which has a positive and extremely low value, so that it can keep desired durability even when driven in a short pulse width. In addition, the heat generating resistive element having the above described composition has a comparatively high sheet resistance value.

A substrate for a liquid discharge head according to the present invention has the above described heat generating resistive element according to the present invention.

A liquid discharge head according to the present invention comprises a discharge port for discharging a liquid, a plurality of heat generating resistive elements according to the present invention for generating thermal energy used for discharging the liquid, and a liquid channel which contains the heat generating resistive element and is communicated with the discharge port.

A liquid discharge head according to the present invention comprises the above described heat generating resistive element according to the present invention, which can keep desired durability even when driven with a short pulse width, so that it can provide the recording images of a high grade over a long period of time. In addition, the above described heat generating resistive element according to the present invention has a comparatively high sheet resistance value, and is suitable for reducing the size of dots formed by discharged droplets in order to realize the higher definition of a recording image. Accordingly, the heat generating resistive element can control heat generation when driven at high speed in order to realize high-speed recording, consequently can enhance energy efficiency and can make the liquid discharge head stably discharge the droplet.

A method for manufacturing a liquid discharge head according to the present invention comprises the steps of: forming a plurality of heat generating resistive elements according to the present invention, which generate thermal energy used for discharging a liquid, in a mixed gas atmosphere consisting of nitrogen gas, oxygen gas and argon gas through a reactive sputtering method; and forming a liquid channel communicated with a discharge port so as to correspond to the heat generating resistive element.

The manufacturing method may further comprise the step of heat-treating the heat generating resistive element, and the step of heat-treating the heat generating resistive element may further comprise applying an electrical pulse for generating the same thermal energy as that used for discharging the liquid, to the heat generating resistive element.

When the heat generating resistive element is heat-treated, the metal silicide of $FeSi_2$ is formed in FeSiON constituting the heat generating resistive element. The intermetallic compound ($FeSi_2$) has thermal stability and low TCR, so that it can improve the durability of the heat generating resistive element. For this reason as well, the composition ratio of Fe to Si is preferably almost 1:2 as in the present invention.

As described above, the present invention can provide a heat generating resistive element capable of providing the recording image of a high grade over a long period of time; a substrate for a liquid discharge head having the heat generating resistive element; the liquid discharge head; and a manufacturing method therefor.

In addition, the present invention can provide a heat generating resistive element for enabling a liquid discharge head to stably discharge a droplet even when the liquid discharge head reduces the size of dots formed by discharged droplets in order to realize the higher definition of a recording image and is driven at high speed in order to realize higher speed recording; a substrate for the liquid discharge head having the heat generating resistive element; the liquid discharge head; and a manufacturing method therefor.

DESCRIPTION OF THE PREFERRED EMBODIMENTS

In the following, embodiments according to the present invention will be described in detail with reference to a plurality of examples. However, the present invention is not limited only to each example described below, but is also naturally applicable to a resistor thin-film used for other uses, so long as they can achieve the objects according to the present invention.

Figure 1:
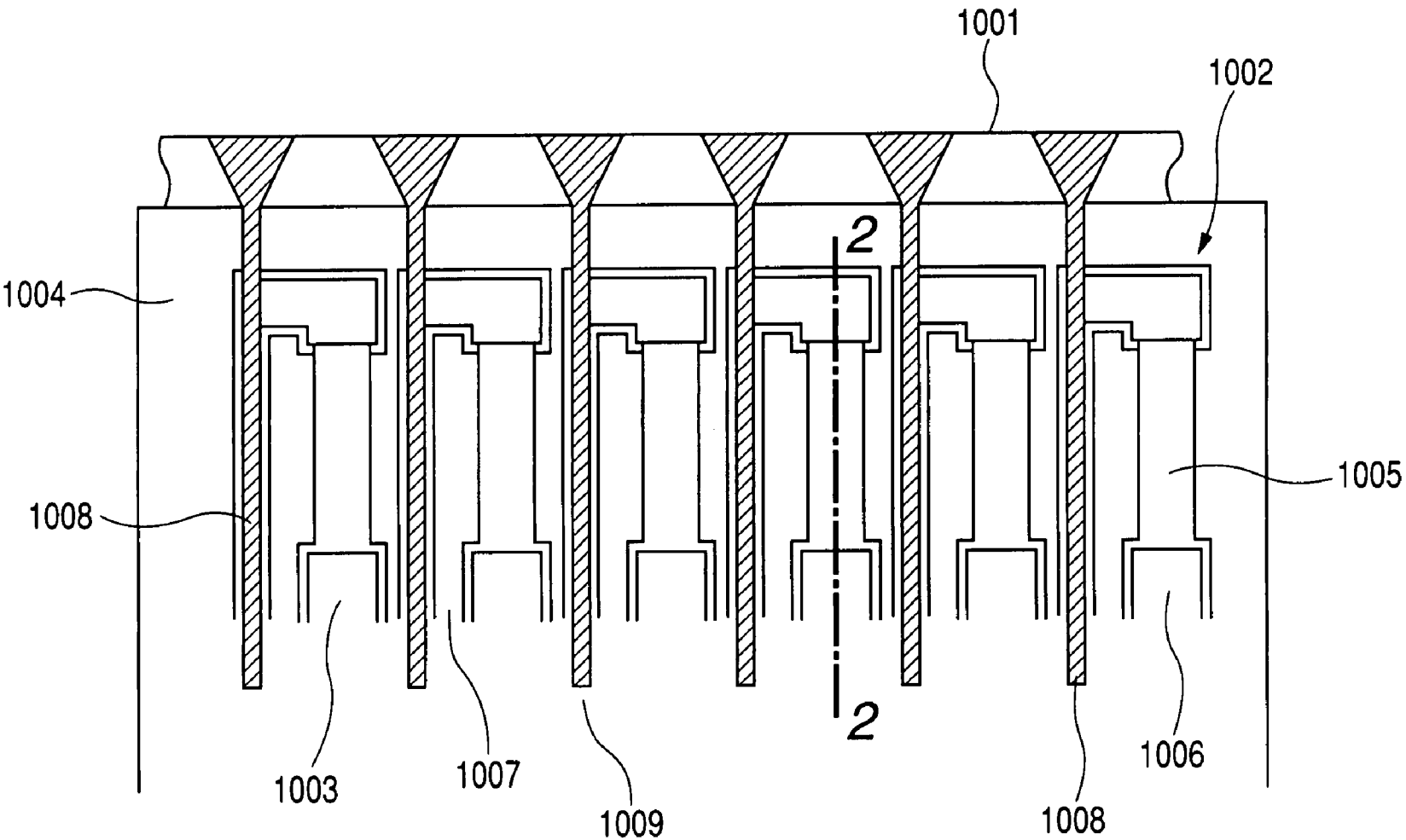
FIG. 1 is a schematic plan view showing the general configuration of an essential part of a substrate in a recording head used for ink jet recording.
Figure 2:
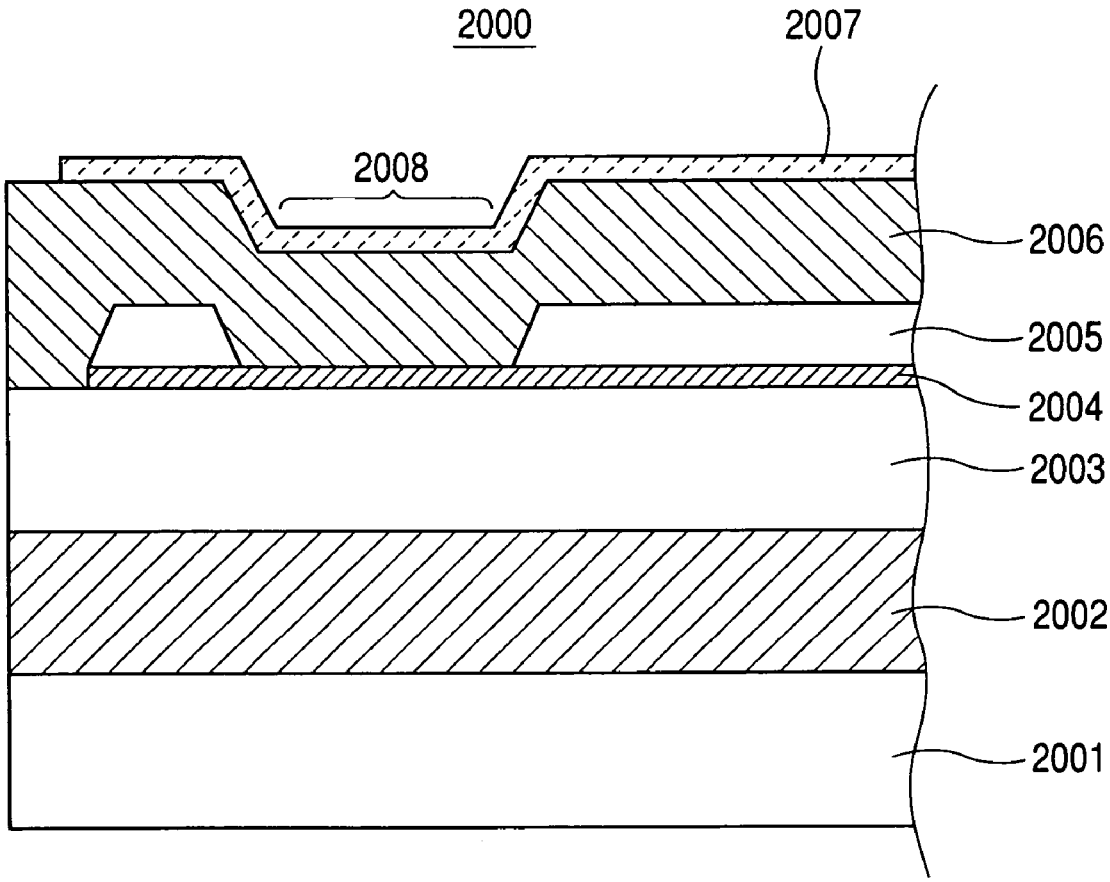
FIG. 2 is a schematic sectional view of a substrate for an ink-jet recording head cut along the 2–2 line corresponding to an ink channel in FIG. 1.
Figure 3A:
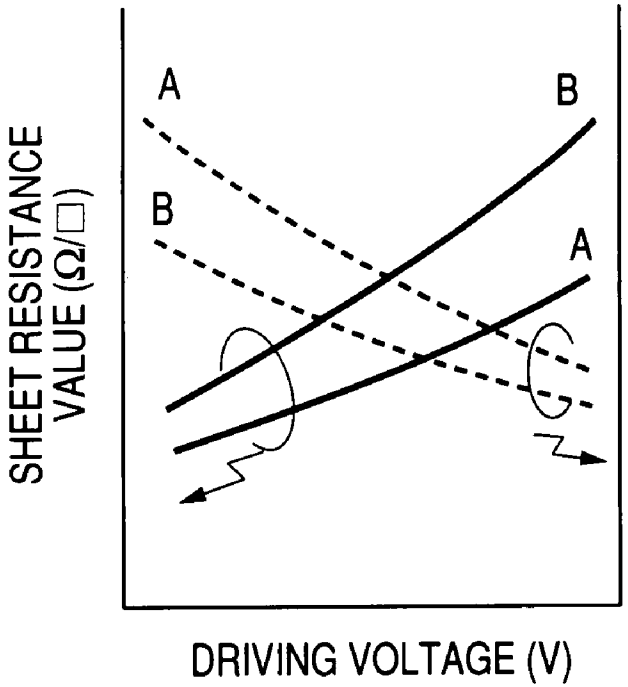
FIGS. 3A and 3B are views for describing a relation between a heater size and various drive conditions.
Figure 3B:
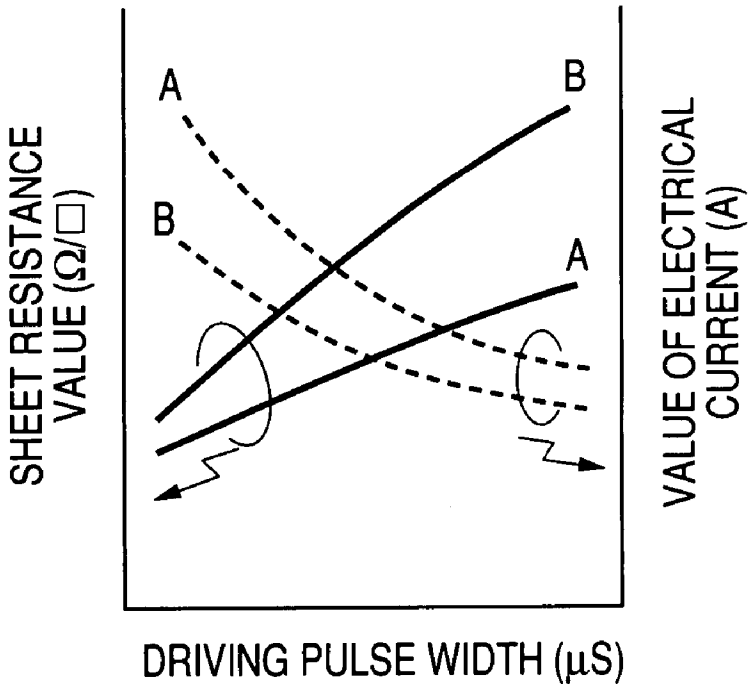
Figure 3B:
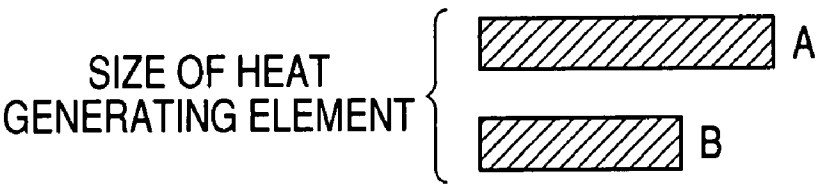
Figure 4:
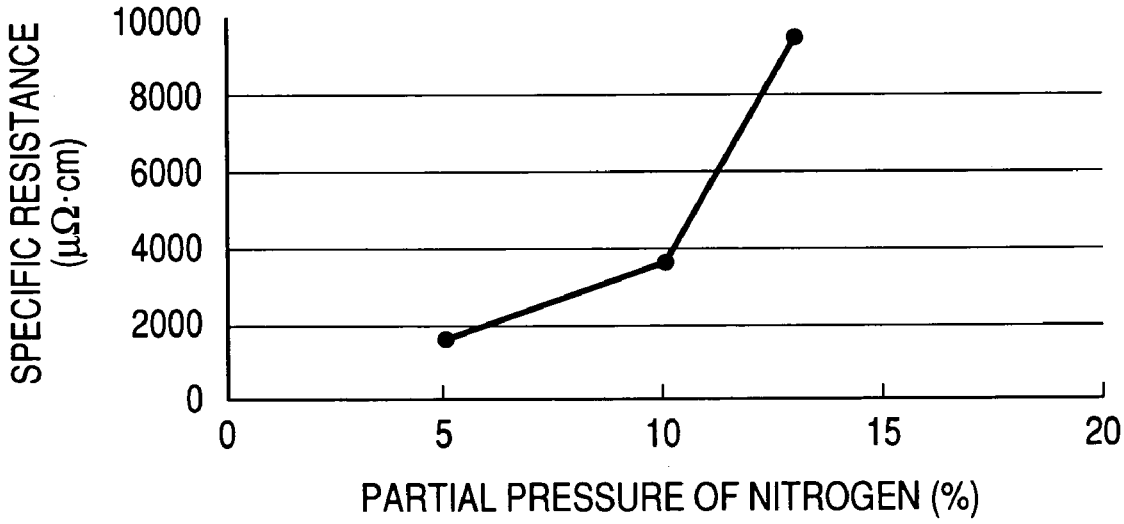
FIG. 4 is a graph showing the result of having evaluated the characteristics of an FeSiN film actually formed with the use of an FeSi target.

The configurations of an essential part of a substrate for an ink jet head and the substrate according to the present embodiments are similar to ones shown in FIGS. 1 and 2, so that the configurations in the present embodiment as well are described referring to FIGS. 1 and 2.

A heat generating resistive layer 2004 can be produced by various film-forming methods, but is generally formed by a magnetron sputtering method with the use of a radio frequency (RF) power source or a direct current (DC) power source as a power source.

Figure 5:
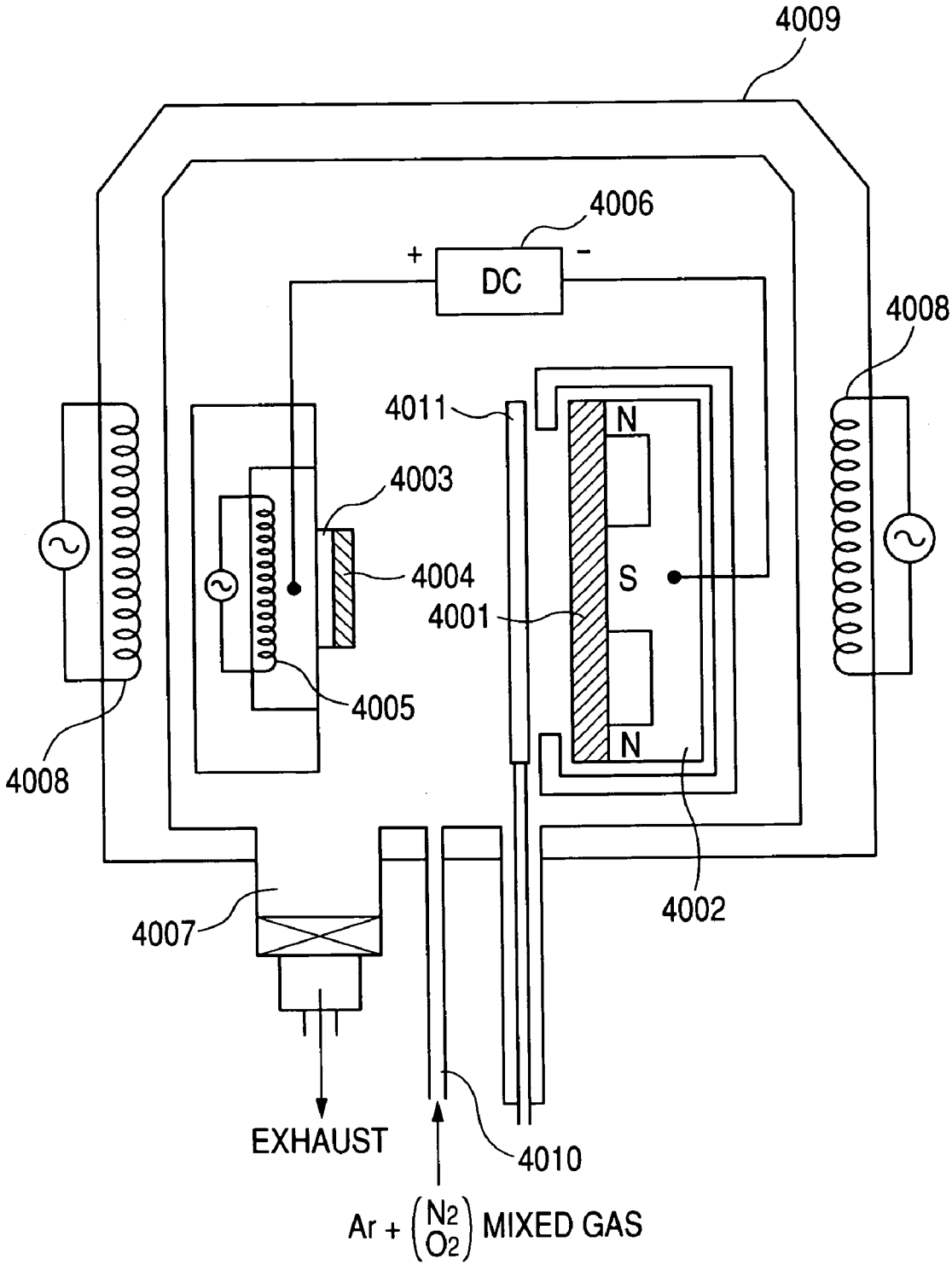
FIG. 5 is a view showing a sputtering apparatus capable of film-forming a heat generating resistive layer shown in FIG. 2.

FIG. 5 is a view showing a sputtering apparatus capable of film-forming a heat generating resistive layer 2004 shown in FIG. 2.

In FIG. 5, a reference numeral 4001 denotes a target made from FeSi previously prepared into a predetermined composition, a reference numeral 4002 a flat magnet, a reference numeral 4011 a shutter for controlling film formation onto a substrate, a reference numeral 4003 a substrate holder for supporting a substrate 4004 in a film-forming chamber 4009, and a reference numeral 4006 a power source connected to the target 4001 and the substrate holder 4003.

Furthermore, in FIG. 5, a reference numeral 4008 shows an external heater installed around the outer wall of a film-forming chamber 4009. The external heater 4008 is used for adjusting an atmospheric temperature in the film-forming chamber 4009. On the rear face of a substrate holder 4003, an internal heater 4005 for controlling the temperature of the substrate is installed. In order to control the temperature of a substrate 4004, preferably the external heater 4008 is concomitantly used.

By using a sputtering apparatus shown in FIG. 5, a heat generating resistive layer 2004 is film-formed in the following way.

At first, a valve 4007 for exhaust is opened, and by using an exhaust pump which is not shown, the inside of a film-forming chamber 4009 is exhausted into the pressure of $1\times10^{-5}$ to $1\times10^{-6}$ Pa. Subsequently, a mixed gas consisting of argon gas, nitrogen gas and oxygen gas is introduced into the film-forming chamber 4009 from a gas admission port 4010 through a mass flow controller (not shown). At this time, so as to make the temperature of a substrate 4004 and the atmosphere temperature in the film-forming chamber 4009 to be predetermined temperatures, an internal heater 4005 and an external heater 4008 are adjusted.

Subsequently, an electric power is applied to a target 4001 from a power source 4006 to generate sputtering discharge, and a shutter 4011 is adjusted to make a thin film (a heat generating resistive layer 2004) formed on a substrate 4004. In addition, when a flat magnet 4002 is rotated during the film formation, the rotation makes high-density plasma and γ-electrons distribute on the target 4001 side, and thereby mitigates the thermal and physical damage given to the substrate 4004.

In the above, a method for forming the film of a heat generating resistive element with a reactive sputtering method using an alloy target consisting of FeSi has been described.

(1) Example of Heat Generating Resistive Element

Subsequently, an example of preparing a heat generating resistive film according to the present invention in various film-forming conditions with the described above film-forming method by using an apparatus shown in FIG. 5 method will be described.

EXAMPLE 1

Referring to FIG. 2, in the present example as has been partly described above, a heat storage layer 2002 having the film thickness of 1.8 μm was formed on a silicon substrate 2001 by thermal oxidation, then an $SiO_2$ film with the thickness of 1.2 μm was deposited on the heat storage layer 2002 with a plasma CVD method to make it an interlayer film 2003 serving also as a heat storage layer. Subsequently, on the interlayer film 2003, an FeSiON film of a heating resistive layer 2004 was formed into the film thickness of 400 angstrom. In the step, the gas flow rates of Ar gas, $N_2$ gas and $O_2$ gas were respectively controlled to 76, 3 and 1 sccm. In addition, in the present example, the target 4001 (cf. FIG. 5) made from $Cr_{30}Si_{70}$ was used, and the power charged from the power source 4006 (cf. FIG. 5) to the target 4001 was controlled to 350 W. In addition, a substrate temperature during film formation was controlled to 200° C.

Furthermore, as a metallic wire 2005 for heating a heat generating resistive layer 2004 in a thermic effect portion 2008, an Al—Cu film was formed into the thickness of 5,500 angstrom by a sputtering technique. Then, the Al—Cu film was patterned by photolithography to form the thermic effect portion 2008 having the size of 15 μm×40 μm, which is an Al—Cu film-removed part.

In addition, an SiN film of a protective film 2006 was formed into the thickness of 1 μm with a plasma CVD method. In the present example, the substrate temperature in the above step was controlled to 400° C., and the substrate was held at the temperature for about one hour, which served also as heat treatment.

Finally, as a cavitation resistant layer 2007, a Ta film was formed into the thickness of 2,000 angstrom with a sputtering technique to provide a substrate 2000 according to the present example. A heat generating resistive layer 2004 in the substrate 2000 provided in the present example showed the sheet resistance value of 550 [Ω/□]. In addition, the heat generating resistive layer 2004 showed the TCR characteristic of about +45 [ppm/° C.]. In addition, the element ratio in the composition of FeSiON constituting the heat generating resistive layer 2004 was 23 at % Fe, 46 at % Si, 28 at % N and 3 at % O.

COMPARATIVE EXAMPLE 1

A substrate in the comparative example 1 was prepared in a similar way to the example 1 except that the way of forming a heat generating resistive layer 2004 was changed to the following way.

Specifically, in the present comparative example, the target 4001 (cf. FIG. 5) was made from Ta, and a $TaN_{0.8}$ film with the thickness of 1,000 angstrom was formed as a heat generating resistive layer 2004 by a reactive sputtering method with the use of the Ta target. In the present comparative example, the mixed gas consisting of argon gas and nitrogen gas was used, the gas flow rates of Ar gas and $N_2$ gas when flowed, were respectively controlled to 64 sccm and 16 sccm, and the partial pressure of nitrogen gas was controlled to 20%. An electric power charged from a power source 4006 (cf. FIG. 5) to the target 4001 was set to 350 W, and a substrate temperature during film formation was controlled to 200° C.

The heat generating resistive layer 2004 of the substrate 2000 obtained in the present comparative example showed the sheet resistance value of 25 [Ω/□].

[Evaluation 1]

By using an ink jet head (a recording head) provided with the substrate prepared in the example 1 and the comparative example 1, a bubbling voltage Vth necessary for a heat generating resistive element (a heater) 1005 to generate bubbles for discharging ink was measured. Then, the value of an electrical current flowing through the heat generating resistive element 1005, when the heat generating resistive element 1005 was driven at the driving voltage of 1.2 Vth which is 1.2 times of the bubbling voltage Vth and at the driving pulse width of 2 μsec, was measured.

As a result, in the example 1, the bubbling voltage Vth was 29 V and the value of an electrical current was 32 mA, whereas in the comparative example 1, the bubbling voltage Vth was 9.9 V and the value of an electrical current was 120 mA. As a result of this, when the substrate in the example 1 is compared to that in the comparative example 1, the value of an electrical current in the example 1 is only about ¼ of that in the comparative example 1. Because in an actual recording head, many heat generating resistive elements 1005 are simultaneously driven, it can be easily understood that the heat generating resistive element in the example 1 consumes the electric power far less than that in the comparative example 1, and consequently shows an energy-saving effect.

Furthermore, the heat generating resistive elements 1005 in the example 1 and the comparative example 1 were driven in the conditions of the driving frequency of 15 kHz, the driving pulse width of 1 μsec, and the driving voltage which is 1.2 times (1.2 Vth) of bubbling voltage Vth, and their heat stress durabilities by breaking pulses were evaluated.

As a result, the heat generating resistive element 1005 in the comparative example 1 was broken at the pulse number of $6.0\times10^7$, whereas the heat generating resistive element 1005 in the example 1 was not broken up to the pulse number of $4.3\times10^9$. It is clear from this fact that the substrate 2000 according to the present the example has adequate durability even when the driving pulse width is shortened.

EXAMPLE 2

A substrate in the comparative example 2 was prepared in a similar way to the example 1 except that the way of forming a heat generating resistive layer 2004 was changed to the following way.

Specifically, a target 4001 (cf. FIG. 5) made from $Fe_{30}Si_{70}$ was used in the present Example. In addition, in the present example, when an FeSiON film was formed into the thickness of 400 angstrom as a heat generating resistive layer 2004, the gas flow rates of an Ar gas, $N_2$ gas and $O_2$ gas were respectively controlled to 71, 8 and 1 sccm. The electric power applied to the target 4001 from a power source 4006 (cf. FIG. 5) was set to 350 W, and a substrate temperature during film formation was controlled to 200° C.

The heat generating resistive layer 2004 of the substrate 2000 thus obtained in the present example showed the sheet resistance value of 970 [Ω/□], and a TCR characteristic of +65 [ppm/° C.]. In addition, the element ratio of the composition of FeSiON constituting the heat generating resistive layer 2004 was 21 at % Fe, 42 at % Si, 33 at % N and 4 at % O.

[Evaluation 2]

In the similar way to the evaluation 1 described above, the substrate 2000 prepared in the example 2 was evaluated. As a result, the substrate 2000 in the example 2 showed the bubbling voltage Vth of 35 V and the value of an electrical current of 18 mA. As a result of the evaluation for heat stress durability by breaking pulses, the heat generating resistive element 1005 was not broken up to the pulse number of $3.0\times10^9$.

From the results which are similar to the results in the evaluation 1, it is clear that the substrate 2000 in the example 2 consumes a little electric power and has a superior energy-saving effect. In addition, it is also clear that the substrate 2000 in the example 2 had adequate durability even when a driving pulse width was shortened.

(2) Example of Substrate for Ink Jet Head

In order to further evaluate the characteristics of a heat generating resistive element when used for the substrate of an ink jet head, an FeSiON film was formed with a film-forming method similar to the above described one by using the sputtering apparatus shown in FIG. 5 as in the example described above, an ink jet head having a heat generating resistive layer 2004 of the FeSiON film was prepared, and the characteristics were evaluated.

EXAMPLE 3

Referring to FIG. 2, in the present example, as a substrate 2000 for an ink jet head, a simple silicon substrate 2001, or a silicon substrate 2001 having an integrated circuit for driving already formed, is used. When the simple silicon substrate 2001 is used, a heat storage layer 2002 with the film thickness of 1.8 μm consisting of $SiO_2$ is formed thereon, by a thermal oxidation method, a sputtering method, a CVD method or the like. When the silicon substrate 2001 having the integrated circuit already formed is used, similarly, a heat storage layer 2002 with the film thickness of 1.8 μm consisting of $SiO_2$ was formed thereon, during the manufacturing process.

Subsequently, an interlayer film 2003 consisting of $SiO_2$ with the thickness of 1.2 μm was formed on the heat storage layer 2002 by a sputtering method or a CVD method. Next, an FeSiON film was formed as a heat generating resistive layer 2004 on the interlayer film 2003. The gas flow rates, at this time, of Ar gas, $N_2$ gas and $O_2$ gas were respectively controlled to 76, 3 and 1 sccm as in the example 1. In addition, in the present example, a target 4001 (cf. FIG. 5) made from FeSi was used, and the electric power applied to the target 4001 from the power source 4006 (cf. FIG. 5) was controlled to 100 W. In addition, a substrate temperature during film formation was controlled to 400° C. The purpose is to extremely decrease a film-forming rate to promote the crystallization of a film. In addition, the substrate temperature was also set to 400° C. for the purpose, which is comparatively high.

Furthermore, an Al film with the thickness of 5,500 angstrom was formed for a metallic wire 2005 by a sputtering technique. Then, the Al film was patterned by photolithography to form a thermic effect portion 2008 having the size of 20 μm×30 μm, which is an Al layer-removed part.

In addition, an SiN film of a protective film 2006 was formed into the thickness of 1 μm with a plasma CVD method. Subsequently, as a cavitation resistant layer 2007, a Ta film was formed into the thickness of 2,300 angstrom with a sputtering technique, a substrate 2000 for an ink jet head was prepared as shown in FIG. 2 by patterning with a photolithographic method, and an ink jet recording head (cf. FIG. 1) further provided with the substrate 2000 for the ink jet head was prepared.

An SST test was conducted with the use of the ink jet head prepared as described above. Here, the SST test was conducted by giving pulse signals having the driving frequency of 15 kHz and the driving pulse width of 1 μsec to a heat generating resistive element 1005, determining a bubbling-starting voltage Vth at which ink discharge was started, then increasing the applied voltage by every 0.05 V from Vth, applying each $1\times10^5$ pulse at the driving frequency of 15 kHz till the heat generating resistive element 1005 was broken, and determining the breaking voltage Vb when it was broken. The ratio of the breaking voltage Vb to the bubbling-starting voltage Vth is called a breaking voltage ratio Kb (=Vb/Vth). The breaking voltage ratio Kb is an index showing the heat resistance of the heat generating resistive element 1005, and means that the higher is the value, the more excellent is the heat resistance of the heat generating resistive element 1005. As a result of evaluating the ink jet head according to the present example, the obtained value for Kb was 1.5.

Subsequently, a heat pulse durability test (a CST test) was conducted at the driving voltage Vop set to 1.3 Vth. In addition, the CST test was conducted by applying pulses to the heat generating resistive element 1005 in the empty state of an ink jet head having no ink (liquid) charged therein. In the CST test, $1.0\times10^9$ pulses of pulse signals having the driving frequency of 15 kHz and the driving pulse width of 1 μsec were continuously applied to the heat generating resistive element 1005, and the rate of change in the ohmic value, ΔR/R0 (ΔR=R−R0), was determined, where R0 is an initial ohmic value of the heat generating resistive element 1005 and R is an ohmic value after the pulses have been applied to the element. As a result, the rate of the change in the ohmic value, ΔR/R0, was +2.5%.

EXAMPLE 4

Referring to FIG. 2, similarly to the example 3 in the present example as well, a simple silicon substrate 2001, or a silicon substrate 2001 having an integrated circuit for driving already formed thereon, was used for the substrate 2000 of an ink jet head. When the simple silicon substrate 2001 was used, a heat storage layer 2002 consisting of $SiO_2$ with the film thickness of 1.8 μm was formed thereon, by a thermal oxidation method, a sputtering method, a CVD method or the like. When the silicon substrate 2001 having the integrated circuit already formed was used, similarly, a heat storage layer 2002 consisting of $SiO_2$ with the film thickness of 1.8 μm was formed thereon, during the manufacturing process.

Subsequently, an interlayer film 2003 consisting of $SiO_2$ with the thickness of 1.2 μm was formed on the heat storage layer 2002 by a sputtering method or a CVD method. Next, an FeSiON film was formed as a heat generating resistive layer 2004 on the interlayer film 2003. The gas flow rates, at this time, of Ar gas, $N_2$ gas and $O_2$ gas were respectively controlled to 76, 3 and 1 sccm as in the example 1. In addition, in the present example as well, a target 4001 (cf. FIG. 5) made from FeSi was used, and an electric power applied to the target 4001 from a power source 4006 (cf. FIG. 5) was controlled to 350 W. In addition, a substrate temperature during film formation was controlled to 200° C.

Furthermore, an Al—Si film with the thickness of 5,500 angstrom was formed as a metallic wire 2005 by a sputtering technique. Then, the Al—Si film was patterned by photolithography to form a thermic effect portion 2008 having the size of 20 μm×30 μm, which is an Al—Si layer-removed part.

In addition, the SiN film of a protective film 2006 was formed into the thickness of 1 μm with a plasma CVD method. In the present example, the substrate temperature in the above step was controlled to 400° C., and the substrate was held at the temperature for about one hour, which served also as heat treatment.

Subsequently, as a cavitation resistant layer 2007, a Ta film was formed into the thickness of 2,300 angstrom with a sputtering technique, the substrate 2000 for an ink jet head was prepared as shown in FIG. 2 by patterning with a photolithographic method, and an ink jet recording head (cf. FIG. 1) provided with the substrate 2000 for the ink jet head was further prepared.

An SST test was conducted with the use of the ink jet head prepared as described above. Here, the SST test was conducted by giving pulse signals having the driving frequency of 15 kHz and the driving pulse width of 1 μsec to a heat generating resistive element 1005, determining a bubbling-starting voltage Vth at which ink discharge was started, then increasing the applied voltage by every 0.05 V from Vth, applying each $1\times10^5$ pulse at the driving frequency of 15 kHz till the heat generating resistive element 1005 was broken, and determining the breaking voltage Vb when it was broken. As a result of evaluating the ink jet head according to the present example, the obtained value for the breaking voltage rate Kb (=Vb/Vth) was 1.7.

Next, a heat pulse durability test (a CST test) was conducted at the driving voltage Vop set to 1.3 Vth. In addition, the CST test was conducted by applying pulses to a heat generating resistive element 1005 in the empty state of an ink jet head having no ink (liquid) charged therein. In the CST test, $1.0\times10^9$ pulses of pulse signals having the driving frequency of 15 kHz and the driving pulse width of 1 μsec were continuously applied to the heat generating resistive element 1005, and the rate of change in the ohmic value, ΔR/R0 (ΔR=R−R0), was determined, where R0 is an initial ohmic value of the heat generating resistive element 1005 and R is an ohmic value after the pulses have been applied to the element. As a result, the rate of the change in the ohmic value, ΔR/R0, was +2.6%.

EXAMPLE 5

In the present example, a substrate 2000 for an ink jet head was prepared in a similar way to the example 4, except that a heat generating resistive layer 2004 (cf. FIG. 2) was formed in the conditions shown in the example 2. Then, an SST test and a CST test were conducted similarly to the example 4 with the use of the substrate 2000 for the ink jet head.

In the present example, before the tests were conducted, heat treatment was carried out on a heat generating resistive element 1005 (cf. FIG. 1), by applying $1.0\times10^3$ pulses of the pulse signals having the driving voltage Vop of 1.4 Vth, the driving pulse width of 1 μsec and the driving frequency of 15 kHz, to the element. When the heat generating resistive element 1005 is heat-treated, metal silicide of $FeSi_2$ is formed in FeSiON constituting the heat generating resistive element 1005. The intermetallic compound ($FeSi_2$) has thermal stability and low TCR, so that it can improve the durability of the heat generating resistive element 1005. For this reason as well, the composition ratio of Fe to Si is preferably almost 1:2 as in the present invention.

As the result of an SST test, the obtained breaking voltage ratio Kb in the present example was the value of 1.5. In addition, as the result of the CST test, the rate of the change in the ohmic value, ΔR/R0, was +4.5%.

EXAMPLES 6 TO 12 AND THE COMPARATIVE EXAMPLES 2 TO 5

An ink jet head was manufactured and evaluated in a similar way to that in the example 1, except that the heat generating resistive layer has the film composition shown in Table 1. The evaluation result is shown in Table 1.

TABLE 1

| | Film composition | SST test (Kb) | CST test (rate (%) of change in ohmic value) | TCR (ppm/° C.) |
|---|---|---|---|---|
| Example 6 | $Fe_{20}Si_{50}N_{32}O_3$ | 1.1 | 4.9 | +110 |
| Example 7 | $Fe_{28}Si_{45}N_{25}O_2$ | 1.2 | 5.0 | +120 |
| Example 8 | $Fe_{15}Si_{35}N_{49}O_1$ | 1 | 5.2 | +140 |
| Example 9 | $Fe_{15}Si_{60}N_{15}O_{10}$ | 1 | 5.2 | +160 |
| Example 10 | $Fe_{30}Si_{35}N_{25}O_{10}$ | 1.2 | 4.8 | +110 |
| Example 11 | $Fe_{20}Si_{60}N_{10}O_{10}$ | 1.1 | 5 | +110 |
| Example 12 | $Fe_{30}Si_{35}N_{25}O_{10}$ | 1.2 | 5.3 | +120 |
| Comparative Example 2 | $Fe_{13}Si_{55}N_{28}O_4$ | 1.0 | 7.3 | +200 |
| Comparative Example 3 | $Fe_{35}Si_{30}N_{23}O_{12}$ | 1.1 | 7.4 | 200 |
| Comparative Example 4 | $Fe_{15}Si_{65}N_8O_{12}$ | 1 | 7 | 210 |
| Comparative Example 5 | $Fe_{10}Si_{34}N_{55}O_1$ | 1 | 7.5 | 250 |

If the Examples 6 to 12 are compared with the Comparative Examples 2 to 5, the value of the breaking voltage ratio Kb by the SST test is substantially the same for both Examples 6 to 12 and Comparative Examples 2 to 5. In the rate of change in ohmic value by CST test and in TCR (temperature coefficient of resistance), the values according to the Examples 6–12 are smaller. As stated above, according to the Examples 6–12, it is possible to manufacture an ink jet head provided with the heat generating resistive layer having properties more excellent than the Comparative Examples 2–5 in total.

This application claims priority from Japanese Patent Application No. 2003-407509 filed Dec. 5, 2003, which is hereby incorporated by reference herein.

What is claimed is:

1. A heat generating resistive element which is used in a liquid discharge head for discharging a liquid from a discharge port by thermal energy, consisting of a composition ratio of 15–30 at % Fe, 35–60 at % Si, 10–50 at % N and 1–10 at % O, in total to 100 at % or substantially 100 at %.

2. A substrate for a liquid discharge head having a heat generating resistive element for generating thermal energy used for discharging a liquid from a discharge port, wherein the heat generating resistive element consisting of a composition ratio of 15–30 at % Fe, 35–60 at % Si, 10–50 at % N and 1–10 at % O, in total to 100 at % or substantially 100 at %.

3. A liquid discharge head having: a discharge port for discharging a liquid; a heat generating resistive element for generating thermal energy used for discharging the liquid, consisting of a composition ratio of 15–30 at % Fe, 35–60 at % Si, 10–50 at % N and 1–10 at % O, in total to 100 at % or substantially 100 at %; and a liquid channel provided with the heat generating resistive element and communicated with the discharge port.

4. A method for manufacturing a liquid discharge head comprising the steps of: forming a heat generating resistive element for generating thermal energy used for discharging a liquid, which consists of a composition ratio of 15–30 at % Fe, 35–60 at % Si, 10–50 at % N and 1–10 at % O in total to 100 at % or substantially 100 at %, in the atmosphere of a mixed gas of nitrogen gas, oxygen gas and argon gas, with a reactive sputtering method; and forming a liquid channel communicated with a discharge port so as to correspond to the heat generating resistive element.

5. The method for manufacturing the liquid discharge head according to claim 4, further comprising a step of heat-treating the heat generating resistive element.

6. The method for manufacturing the liquid discharge head according to claim 5, wherein the step of the heat-treating the heat generating resistive element is carried out by applying electrical pulses for generating the same thermal energy as that used for discharging the liquid, to the heat generating resistive element.

* * * * *

UNITED STATES PATENT AND TRADEMARK OFFICE

CERTIFICATE OF CORRECTION

PATENT NO. : 7,140,721 B2
APPLICATION NO. : 11/001054
DATED : November 28, 2006
INVENTOR(S) : Hiroyuki Suzuki et al.

It is certified that error appears in the above-identified patent and that said Letters Patent is hereby corrected as shown below:

COLUMN 1
Line 38, "an 2-2 line" should read --a 2-2 line--.

COLUMN 7
Line 43, "described above" should read --above-described--.
Line 59, "76," should not be bold.

COLUMN 9
Line 14, "the example" should read --example--.
Line 28, "71," should not be bold.

COLUMN 10
Line 15, "76" should not be bold.

COLUMN 11
Line 28, "71" should not be bold.

COLUMN 14
Line 22, "of the" should read --of--.

Signed and Sealed this

Twenty-fifth Day of December, 2007

JON W. DUDAS
*Director of the United States Patent and Trademark Office*